US005821963A

United States Patent [19]

Sutera et al.

[11] Patent Number: 5,821,963

[45] Date of Patent: Oct. 13, 1998

[54] CONTINUOUS INK JET PRINTING SYSTEM FOR USE WITH HOT-MELT INKS

[75] Inventors: Richard Sutera, Schaumburg; Ronald Stephen Modica, Franklin Park; Mairi Campbell MacLean, South Elgin; Jaroslaw Sterna, Barrington, all of Ill.

[73] Assignee: Videojet Systems International, Inc., Wood Dale, Ill.

[21] Appl. No.: 941,177

[22] Filed: Sep. 30, 1997

Related U.S. Application Data

[63] Continuation of Ser. No. 307,195, Sep. 16, 1994, abandoned.

[51] Int. Cl.[6] ..... B41J 2/045

[52] U.S. Cl. ..... 347/68; 347/75; 347/88

[58] Field of Search ..... 347/88, 20, 68, 347/73, 70, 75, 89, 90

[56] References Cited

U.S. PATENT DOCUMENTS

| | | |
|---|---|---|
| 3,298,030 | 1/1967 | Lewis et al. . |
| 3,373,437 | 3/1968 | Sweet et al. . |
| 3,560,641 | 2/1971 | Taylor et al. . |

(List continued on next page.)

FOREIGN PATENT DOCUMENTS

| | | | |
|---|---|---|---|
| A-0 109 754 | 5/1984 | European Pat. Off. . | |
| A-0 228 828 | 7/1987 | European Pat. Off. . | |
| 506395 | 9/1992 | European Pat. Off. . | |
| A-0 623 472 | 11/1994 | European Pat. Off. . | |
| 55-54368 | 4/1980 | Japan | 347/88 |
| 4-187440 | 7/1992 | Japan | 347/75 |

OTHER PUBLICATIONS

Beach et al, IBM technical Disclosure Bulletin, vol. 24, No. 4 Sep. 1981, p. 1817.

Patent Abstracts of Japan, vol. 6 No. 153(M–149) (1031) Aug. 13, 1982 and JP–A–57 070667 (Ricoh K.K.).

Rossman, "Hot–melt printing technologies," *Tappi Journal,* vol. 75, pp. 111–115 (Apr. 1992).

Research Dislcosure Article No. 317089.

*Primary Examiner*—John E. Barlow, Jr.

*Attorney, Agent, or Firm*—Leydig, Voit & Mayer Ltd.

[57] ABSTRACT

A continuous ink jet printing system for use with a hot-melt ink, comprising a supply chamber for retaining said ink in a liquid form, means for applying heat to the ink in said chamber to maintain said ink in a liquid form, means for conveying said ink in liquid form from said chamber to a printhead for projection toward a substrate to be marked, catcher means for collecting any of said ink that is not directed to said substrate, means for returning the collected ink as a liquid to the supply chamber, and means for maintaining the ink as a liquid while it is being returned to said supply chamber.

Also disclosed is an ink jet nozzle for use in printing hot-melt inks at elevated temperatures comprising an ink jet nozzle body, a transducer, means for acoustically coupling said transducer to said body, and means for maintaining said transducer acoustically coupled to said body at elevated temperatures.

Also disclosed is a flexible, heated umbilical tube comprising an inner tube having an inside wall and an outside wall, a heating element that is adjacent the outer wall of the tube, and an insulating layer that surrounds the heating element and thermally insulates it from the environment.

3 Claims, 5 Drawing Sheets

U.S. PATENT DOCUMENTS

| | | | |
|---|---|---|---|
| 3,586,907 | 6/1971 | Beam et al. . | |
| 3,596,275 | 7/1971 | Sweet et al. . | |
| 3,653,932 | 4/1972 | Berry et al. . | |
| 3,701,998 | 10/1972 | Mathis . | |
| 4,455,474 | 6/1984 | Jameson et al. . | |
| 4,553,023 | 11/1985 | Jameson et al. . | |
| 4,607,261 | 8/1986 | McCann et al. . | |
| 4,631,557 | 12/1986 | Cooke et al. . | |
| 4,658,274 | 4/1987 | DeYoung . | |
| 4,667,206 | 5/1987 | DeYoung . | |
| 4,682,185 | 7/1987 | Martner . | |
| 4,682,187 | 7/1987 | Martner . | |
| 4,684,956 | 8/1987 | Ball . | |
| 4,739,339 | 4/1988 | DeYoung et al. . | |
| 4,750,005 | 6/1988 | Piatt et al. | 347/89 |
| 4,814,330 | 3/1989 | Hoisington et al. . | |
| 4,814,786 | 3/1989 | Hoisington et al. . | |
| 4,823,146 | 4/1989 | Cooke et al. . | |
| 4,857,940 | 8/1989 | Rueping | 347/90 |
| 4,862,192 | 8/1989 | Slomianny | 347/7 |
| 4,864,330 | 9/1989 | Creagh et al. . | |
| 4,870,431 | 9/1989 | Sousa et al. | 347/25 |
| 4,873,539 | 10/1989 | DeYoung . | |
| 4,890,119 | 12/1989 | Eremity et al. . | |
| 4,937,598 | 6/1990 | Hine et al. . | |
| 4,940,995 | 7/1990 | Hine et al. . | |
| 5,030,972 | 7/1991 | Miyazawa et al. . | |
| 5,115,251 | 5/1992 | Gray . | |
| 5,160,939 | 11/1992 | Bajeux et al. . | |
| 5,170,177 | 12/1992 | Stanley et al. . | |
| 5,189,438 | 2/1993 | Hine et al. . | |
| 5,223,860 | 6/1993 | Loofbourow et al. . | |
| 5,235,350 | 8/1993 | Lin et al. . | |
| 5,248,087 | 9/1993 | Dressler . | |
| 5,270,730 | 12/1993 | Yaegashi et al. . | |
| 5,286,288 | 2/1994 | Tobias et al. . | |
| 5,418,561 | 5/1995 | Fujioka | 347/88 |

CONTINUOUS INK JET PRINTING SYSTEM FOR USE WITH HOT-MELT INKS

This is a continuation of application Ser. No. 08/307,195 filed on Sep. 16, 1994, abandoned.

FIELD OF THE INVENTION

This invention relates to the field of continuous ink-jet printing, particularly to hot melt inks, and more particularly, to a new and improved system for continuously printing a hot-melt ink.

BACKGROUND OF THE INVENTION

In continuous ink-jet printing, ink is emitted in a continuous stream under pressure through at least one nozzle. The stream is perturbed, causing it to break up into droplets at a fixed distance from the nozzle. At the break-up point, the droplets are charged in accordance with digital data signals and passed through an electrostatic field which adjusts the trajectory of each droplet in order to direct it to a catcher for recirculation or to a specific location on the recording medium. Inks useful in continuous jet printing operations must be able to sustain an electric charge, and must have a viscosity sufficiently low to allow ink flow through the nozzle.

Typically, the inks used for continuous ink-jet printing are liquid at room temperature. Liquid inks present various difficulties: for example, they respond differently depending upon the type of printing media used. The use of liquid ink on office papers will produce a feathered appearance because the ink penetrates and spreads into the paper following fiber lines. Liquid inks that are designed for minimum feathering still require time to set, which may limit the rate that printed pages are stacked.

The print quality usually depends on the type of paper used, which also has an effect on the drying time and on waterfastness. Although water-borne inks have been widely used, they exhibit poor waterfastness. Also, in order to prevent the ink from drying in the jet, high concentrations of humectant such as diethylene glycol have been used. This also leads to a long drying (set) time for the print on the medium and poor print quality.

Liquid inks without curable additives typically are not useful on nonporous surfaces, such as metal, glass, or plastic, because they are too prone to smearing. Further, liquid inks are very sensitive to temperature changes which influence the ink viscosity and interfacial tension, which, in turn, influence the ink interaction with the medium.

It is clear from the foregoing that major problems with liquid ink-jet inks are (1) media dependent quality, (2) poor reliability, (3) poor waterfastness, and (4) a long drying (set) time for the printed ink.

One method of solving several of the above-mentioned problems is to use what is termed a hot-melt ink. This ink is normally in a solid phase at room temperature, and in a fluid phase at the operating temperature of the printer. When the ink is heated, it melts to form a low viscosity fluid that can be ejected as droplets. Upon jetting, heated droplets impact the substrate and immediately freeze on the medium surface.

Hot-melt inks have numerous advantages over conventional inks that are liquid at room temperature. Hot-melt inks "dry" on the substrate at an extremely rapid rate, i.e., in approximately 10 milliseconds, without the use of solvents to promote drying. This phenomenon allows dark, sharply defined print to be produced on a wide variety of substrates. This print may be slightly raised, suggesting that the print is engraved.

Further, because the ink dries via a phase change from the liquid phase to the solid phase, avoiding the use of solvent, emissions of volatile organic compounds are non-existent, as are other evaporative losses. Also, since the ink is solid at room temperature, during storage and shipment, the colorant systems have less tendency to separate out of the ink. This has facilitated the use of various colorant systems, such as certain pigment-based systems, which would not have normally been used in liquid inks.

Despite the aforementioned advantages of hot melt inks, they have not been used in continuous ink-jet printing. The low molecular weight waxes and polymers typically present in hot melt inks have low polarity and show very poor solvating ability towards ionic polar material used as electrolytes in continuous ink-jet printing. To sustain the electric charge required for continuous ink-jet printing, the electrolyte ions must dissociate in the ink composition, thereby allowing ionic separation upon application of an external electric field.

Recently, however, improved hot melt inks which have good conductivity, low volatility, low resistance, and acceptable viscosity have been described in U.S. Pat. No. 5,286,288.

These improved hot-melt inks, however, cannot be advantageously used in presently available continuous jet printing systems, because those systems are adapted for use only with inks that are liquid at room temperature. The very advantage of hot-melt inks, their rapid drying rate, makes their use in continuous jet systems problematic.

Thus, conventional continuous jet printing systems, such as those disclosed in U.S. Patent No. 3,596,275, and U.S. Patent No. 4,607,261 cannot utilize hot-melt inks.

SUMMARY OF THE INVENTION

The present invention overcomes the problems associated with prior art continuous ink-jet printing systems, and achieves distinct advantages thereover. In accordance with one aspect of the present invention, a continuous jet printing system for use with hot-melt inks is provided that comprises a supply chamber for retaining said ink in a liquid form, means for applying heat to the ink in said chamber to maintain said ink in a liquid form, means for conveying said ink in liquid form from said chamber to a printhead for projection toward a substrate to be marked, catcher means for collecting any of said ink that is not directed to said substrate, means for returning the collected ink as a liquid to the supply chamber, and means for maintaining the ink as a liquid while it is being returned to said supply chamber. If necessary the system may also comprise additional means for maintaining the collected ink as a liquid at the catcher means.

It is now possible to use hot-melt inks for continuous ink jet printing, thereby obtaining the aforementioned benefits of the hot-melt ink over liquid inks, coupled with the inherent advantages of continuous ink jet printing.

The continuous ink jet printing system of the present invention may also comprise, and preferably does comprise, a plurality of retention chambers in sequence with the supply chamber: a first retention chamber for collecting ink recirculated from the catcher means, a second retention chamber in communication with the first chamber, and a supply chamber in direct communication with at least one of the retention chambers and with the printhead, wherein the chambers preferably are in thermal communication and are located in a single thermally conductive vessel.

In a specific embodiment of the present invention, there is provided an ink jet print nozzle assembly that is particularly adapted to provide consistent print capability over a wide range of print operating temperatures.

Further, the present invention provides a flexible, heated umbilical tube comprising an inner tube having an inside wall and an outside wall, a heating element that is disposed about the circumference of, and preferably adjacent to, the outer wall of the tube, and an insulating layer that surrounds the heating element and thermally insulates it from the environment.

BRIEF DESCRIPTION OF THE DRAWINGS

The subsequent description of the preferred embodiments of the invention refers to the attached drawing wherein.

DETAILED DESCRIPTION OF PREFERRED EMBODIMENTS

Figure 1:
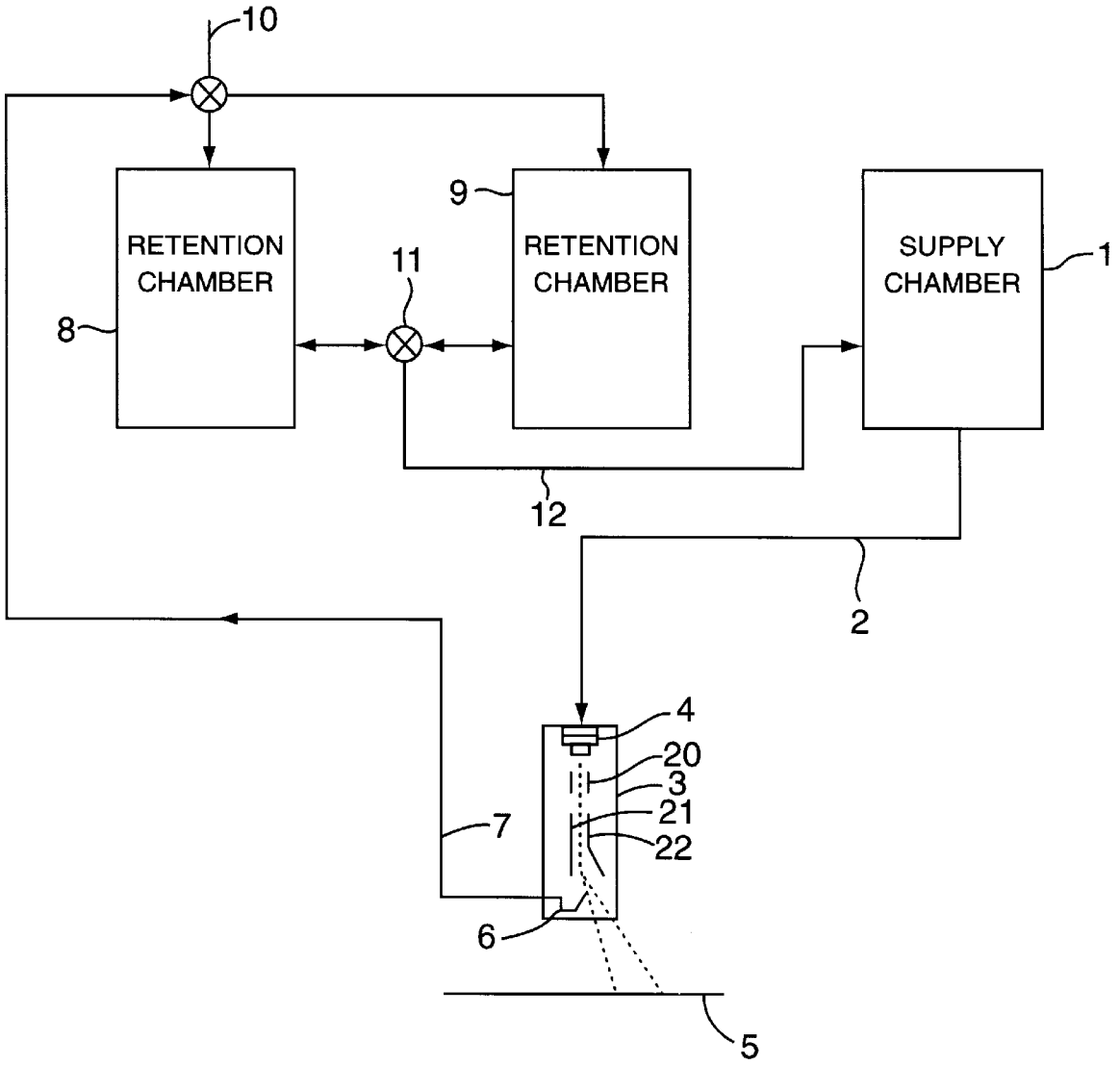
FIG. 1 is a schematic illustration of one embodiment of the continuous jet printing system of the present invention.

FIG. 1 illustrates schematically one embodiment of the continuous ink jet printing system of the present invention for use with hot-melt inks. In general, the system comprises a supply chamber 1, which supplies hot-melt ink in the liquid phase via supply line 2 to printhead 3. Supply chamber 1 is constructed from a thermally conductive metal, or metal alloy. Preferably, supply tank 1 is constructed of aluminum. Supply chamber 1 is held in a vessel, which can be constructed of stainless steel. Heat is passed through the vessel and the walls of supply chamber 1 to maintain the hot-melt ink in chamber 1 in the liquid phase. Various heating means may be used to supply heat to chamber 1, including electric heaters. Hot oil or steam jackets may be used, however, electric heaters are preferred. Sufficient heat should be applied to keep the ink at a temperature slightly above its melting point. The temperature should be sufficiently high so that the viscosity is such as to allow fluid flow at reasonable pressures, that is, a temperature of 10° to 20° C. above the melt temperature, a viscosity range of 25 to 35 cp. Although the ink may be kept at higher temperatures, up to and including the temperature at which the ink is printed, it is preferred that the ink be kept at a temperature 10° to 20° C. above its melting point to minimize ink degradation. The vessel retention chamber 1 should also be insulated to minimize heat loss. Any known insulating material may be used.

When the printing system of the present invention is operating, ink flows from supply chamber 1 through heated supply line 2, and into printhead 3 for ejection through nozzle 4 to either the substrate 5 or the catcher means 6. Details of construction of the preferred nozzle 4 are set forth subsequently. The stream of ink that flows through the nozzle may be perturbed by any convenient means to cause it to break into droplets of the desired uniformity. Typically, this is done by use of a transducer, as is well known in the art. Typically, the transducer is driven by a sinusoidal wave of desired frequency and amplitude to achieve the desired droplet pattern. It is preferred, however, to use the method described in the copending application by Clark et al (Attorney Docket No. 61778) entitled "Method and Apparatus for Continuous Ink Jet Printing," for purposes of perturbing the ink stream into discrete droplets.

In FIG. 1, supply line 2, can be a short, flexible line, (or the printhead can be directly attached to supply chamber 1, thus eliminating the need for a heated flexible or non-flexible line) and is heated to keep the ink in its liquid phase as it flows to the printhead 3. Various heating means can be used to supply heat to supply line 2, such as electric. Use of a heated umbilical line is preferred. Supply line 2 can be insulated using known insulating materials to reduce heat loss from the line and to keep the line at a uniform temperature, thus preventing any "cold spots" in the line, which would cause ink solidification.

Figure 8:
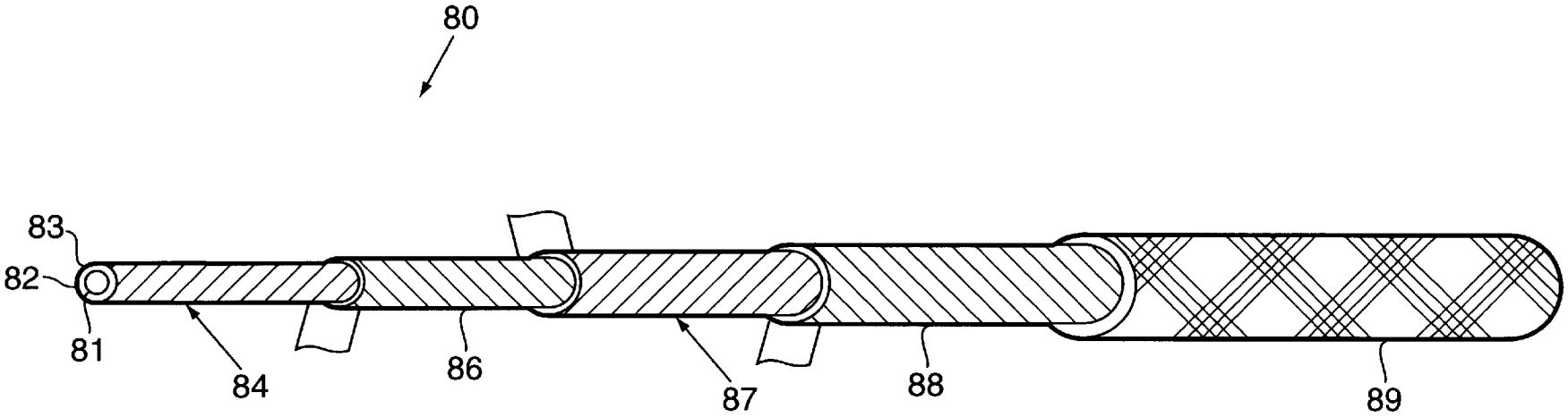
FIG. 8 is a heated umbilical tube of the present invention.

A preferred embodiment for the supply line 2 and return line 7 is shown in FIG. 8. In that embodiment, the supply line 2 and return line 7 is in the form of a flexible, heated umbilical. The umbilical 80 is a conduit (pipe, tube or the like) comprised of an inner tube 82 having an inside wall 81 and an outside wall 83, a heating element 84 that is adjacent the outer wall 83 of the tube 82, and an insulating layer 86 that surrounds the heating element 84 and thermally insulates it from the environment.

The inner tube may be made of any flexible material that is not porous to the hot melt ink in its liquid state and which will withstand the high temperatures associated with the hot melt ink in its liquid state. Preferably, the tube is comprised of polytetrafluoroethylene ("PTFE").

The insulating layer may itself be comprised of more than one material or layer. Preferably, the insulating layer is comprised of two layers of insulating tape, (87, 88) such as that made of mica. It is especially desirable if the layers are wound about the circumference of the tube, and in opposite directions. It is preferred that such tape be wound helically around the circumference of the tube.

It is most preferable if the umbilical has yet another layer of material, over the insulating layer, to protect the insulating layers from physical damage. Such a layer is preferably comprised of PTFE, or other similar material. It is useful to also provide for resistance against pressure and abrasion of the umbilical, by use of an external layer that imparts physical strength. An especially useful means of doing so is to use an external braided layer, such as of fiberglass, polyester, aramid fiber, or the like.

The umbilical needs to meet certain criteria to be useful, especially as to absolute size and flexibility. By having a small, flexible umbilical, it is possible to locate the printhead in many different and difficult locations. Accordingly, the preferred umbilical should have an outside diameter that is in the range from about 0.2 to about 0.3 in., most preferably from about 0.21 to about 0.26 in.

As stated, the umbilical also should be flexible. Preferably the umbilical will have a bending modulus EI less than about $1.6\times10^{-3}$ $Nm^2$. Most preferably, the bending modulus will be from about 1.2 to about $2.0\times10^{-3}$ $Nm^2$. An umbilical was constructed in accordance with FIG. 8, wherein the inner tube was made of PTFE tubing having an inside diameter of 0.066 in. and an outside diameter of 0.132 in. The heating element was comprised of heater tape having a width of one-sixth inch and a resistivity of 1.9 ohm per foot. The heater tape had a single strand of copper wire embedded in a silicone adhesive backing, which faced the inner tube. The heater tape had an aluminum layer on the opposite face, with a total thickness of the tape being about 0.025 in. The heater tape was helically wrapped around the circumference of the inner tube with two layers of mica tape, each layer being helically wrapped in opposite directions. In place of mica, layers of other materials could be used, such as nylon, paper, rubber, silicone, or the like.

A PTFE tape was then wrapped around the mica layer. Similarly, a layer of another material could be used in place of the PTFE, such as any of the materials listed above as alternatives to mica. Finally, a fiberglass braid was placed over the exterior. The diameter of the finished umbilical, with all layers, was 0.238 in. Thus, the layers exterior to the inner tube were a total thickness of only 0.053 in. The flexibility of the umbilical was then measured.

A measured length of the umbilical was supported in a vise and the subsequent deflection of the umbilical, due to its self weight, was measured. Bending modulus EI is calculated in accordance with the following formula:

$$EI=wb^4/8\delta$$

wherein:

EI=equivalent bending modulus in $Nm^2$ w=weight per unit length in $kgm^{-1}$

δ=maximum deflection in m b=cantilevered length in m.

The umbilical as described was determined to have a weight per unit length of $4.6\times10^{-2}$ kg/m. It is desired for the umbilical cord to be constructed so that it has a weight per unit length of from about $3.5\times10^{-2}$ kg/m to about $5\times10^{-2}$ kg/m, preferably from about $4.0\times10^{-2}$ kg/m to about $4.8\times10^{-2}$ kg/m.

Application of the formula is based on the assumption that the supported end was fixed. The respective deflection for ten different cantilevered lengths was measured and plotted to yield a straight line fit, the equation of the line being:

$$y=14877x+10796$$

wherein $y=^4$. By choice of an arbitrary value for deflection, such as 5 in., the foregoing equation yields a cantilevered value of 17 in. Converting those values to SI equivalents, and substituting into the general equation, yields an EI value of $1.6\times10^{-3}$. Such an EI value is comparable to that of a stainless steel rod having a diameter of only 0.023 in. or to a PTFE rod of only 0.184 in, thus showing the extreme flexibility of the umbilical of the present invention.

The temperature of the ink may be raised in supply line 2 and return line 7 to a temperature approaching the temperature needed for printing, with the remaining temperature increase accomplished in printhead 3. For optimum printing, the ink temperature should be from about 75° C. to about 140° C. in the printhead 3, with a temperature from about 90° C. to about 125° C. being preferred. Higher temperatures are acceptable although they may reduce the lifetime of the ink and the printhead. Generally, the operating temperature is selected to obtain suitable ink viscosity while avoiding extensive fuming or smoking.

Printhead 3 may be a conventional continuous jet printhead, additionally having means to heat the ink in the printhead to the operating temperature, and heated catcher means 6. During printing operations some of the hot-melt ink droplets are intercepted by catcher means 6, which is heated to a temperature slightly above that at which the ink solidifies.

Typically, the catcher means should be heated to a temperature above the melting point of the ink being used. The catcher 6 can be heated by various means, including electrical heating wire, or a cartridge heater. A cartridge heater is preferred. The catcher means 6 should be constructed of thermally conductive metal such as stainless steel or nickel and may be surrounded by a block of insulating plastic to prevent heat loss from the catcher means. Other insulating materials can also be used, such as mica or refractory.

A preferred embodiment of the catcher is shown in U.S. Pat. No. 4,890,119. The typical design of such a catcher for use with solvent based inks employs a relatively thin-walled structure, with relatively poor heat conductivity and heat capacity. Accordingly, if such a structure is used in that form, it is necessary to insulate the catcher from the environment and to employ heating means to maintain the catcher at a sufficiently high temperature to allow the hot melt ink to remain in liquid state.

It is preferred, however, to use a catcher that is made of a material that has a relatively good heat conductivity and high heat capacity. As an example, the same general configuration of the catcher shown in the aforementioned patent can be employed, but with the material of construction being stainless steel or the like, and the walls or associated components of the catcher being sufficiently thick to provide a heat-sink effect. In such an embodiment, the means to maintain the ink in liquid state at the catcher may simply be the heat-sink effect of the catcher, in combination with the high temperature of the ink as it exits the printhead.

The liquid hot melt ink can flow directly from recirculation line 7 to supply chamber 1 for reuse. However, it is preferred that the ink flow from recirculation line 7 into retention chamber 8 or retention chamber 9. Such a three chamber system is preferred to allow refill of new ink without interrupting the print process. The ink is directed to a specific chamber by operation of valve 10. Retention chamber 8 and retention chamber 9 are preferably contained in the same vessel housing supply chamber 1. This eliminates the need for supply chamber 1, retention chamber 8, and retention chamber 9 to have discrete heating elements and controls, and allows the ink to be held at the same temperature in each of the three chambers. Additionally, by locating the three chambers within a single vessel, the continuous ink jet system of the present invention can be made sufficiently compact to allow for printing in small spaces, without the need to use a long flexible supply line 2 to transmit ink from the supply chamber 1 to printhead 3.

Retention chamber 8 and retention chamber 9 are preferably contained in the same vessel housing supply chamber 1. This eliminates the need for supply chamber 1, retention chamber 8, and retention chamber 9 to have discrete heating elements and controls, and allows the ink to be held at the same temperature in each of the three chambers. Additionally, by locating the three chambers within a single vessel, the continuous ink jet system of the present invention can be made sufficiently compact to allow for printing in small spaces, without the need to use a long flexible supply line 2 to transmit ink from the supply chamber to printhead 3.

Retention chambers 8 and 9 are heated by the heating means used to heat supply chamber 1, which is described above. The chambers 8 and 9 should be made of a thermally conductive metal or metal alloy, such as aluminum or stainless steel. Aluminum is preferred. Ink can be passed from retention chamber 8 to either retention chamber 9 or supply chamber 1 by operation of a valve 11 on line 12. Likewise, ink can be passed from retention chamber 9 to either retention chamber 8 or supply chamber 1 by operation of valve 11. Line 12 should be kept at a temperature the same or nearly the same as the temperature of the chambers. Various heating means can be used to accomplish the heating at line 12, with electrical heating tape being preferred. Line 12 should also be insulated, preferably with mica tape. Charge electrodes 20 which selectively charge the ink droplets so that upon projection through an electrostatic field established by deflection plates 21 and 22, each droplet is deflected in accordance with its charge level and thereby is controlled to impinge on the appropriate target location, either a location on the substrate or into the catcher, all well known in the art, as is the associated circuitry that is used to apply such a charge.

Thus, when the continuous ink jet system of the present invention is in operation, ink will flow from supply chamber 1, through supply line 2, to printhead 3. Preferably, the ink is maintained under static air pressure via an air pressure supply means not shown. The ink will then be ejected from the printhead 3 via nozzle 4, with some of the ink being directed to a substrate 5, and some of the ink being directed to catcher means 6. From catcher means 6, the unused ink will flow via recirculation line 7 into either retention chamber 8 or retention chamber 9, via a vacuum in the appropriate retention vessel which may be supplied by an external vacuum source, not shown. The ink will then reenter the supply chamber 1 by application of air pressure which may be supplied by an external source of air pressure, not shown, and the process will be repeated on a continuous basis.

Thus, the ink may be moved through the system by varying the pressure or vacuum in the various chambers and lines. In one embodiment of the foregoing, retention chamber 8 is used to as a sump tank and retention chamber 9 is used as a transfer tank. Return ink then flows into chamber 8, due to vacuum in that chamber, supplied from the external vacuum source. Chamber 8 is isolated from chamber 9 when such vacuum is present in chamber 8. Chamber 9 is independently pressurized from an external air source, which then causes ink to flow to the chamber 1, when desired. When the level of ink in the chamber 9, acting as a transfer tank, reaches a predetermined low level, that chamber is isolated from chamber 1, and the air pressure released. Chamber 9 is then allowed to communicate with chamber 8, and ink flows from chamber 8 to chamber 9 under gravity. Alternatively, the roles of chambers 8 and 9 can be switched, with chamber 8 becoming the transfer tank and chamber 9 a sump tank. In that instance chamber 8 would then be supplied with air pressure from an external source, and ink, when required, would flow from chamber 8 directly to chamber 1. The advantage of the configuration shown in FIG. 1 is that the need for a pump to move the ink from one chamber to another is eliminated.

Figure 1A:
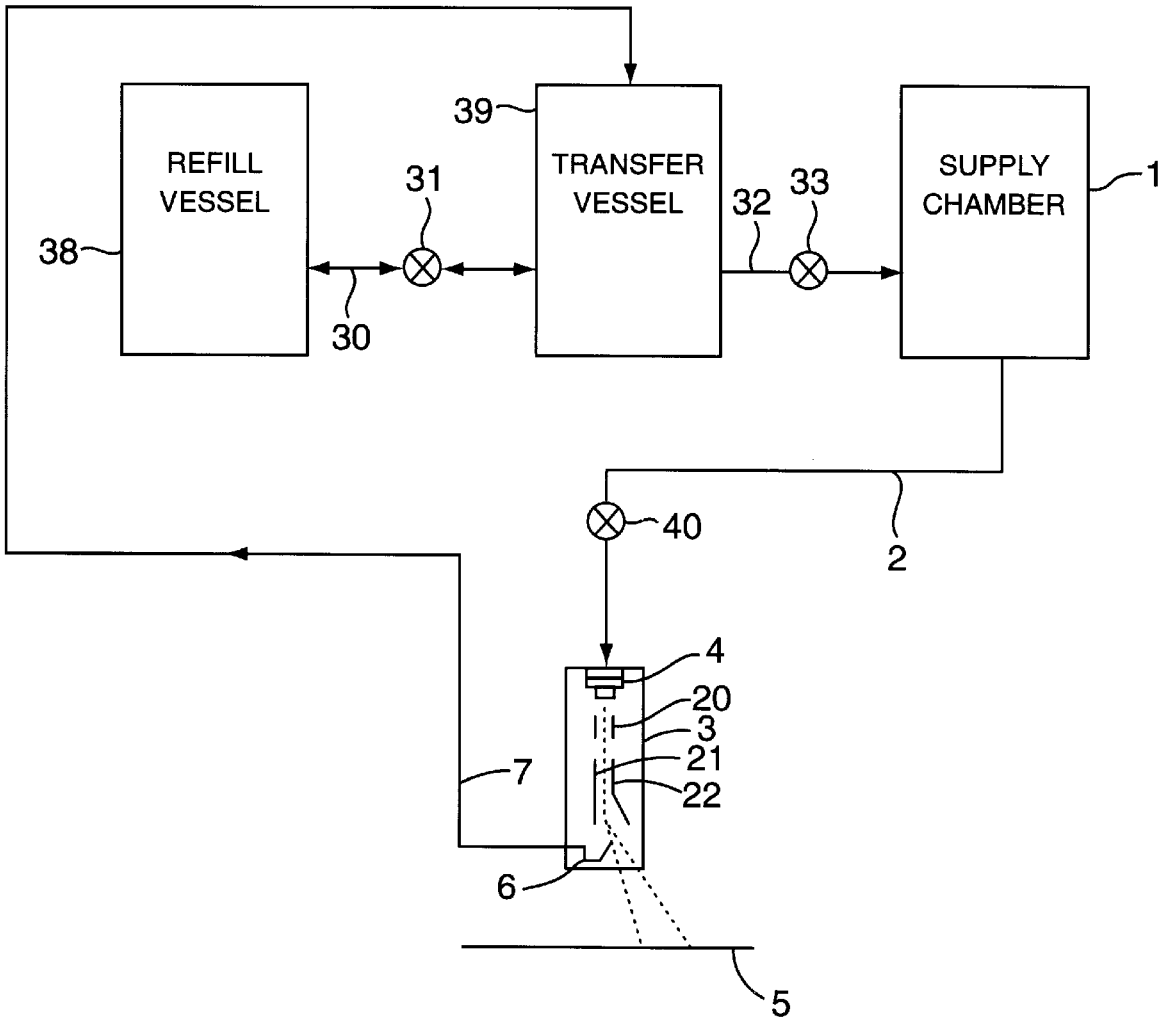
FIG. 1A is a schematic illustration of another embodiment of the continuous jet printing system of the present invention.

As an alternative to the embodiment shown in FIG. 1, the embodiment of FIG. 1A may be employed. In accordance with that embodiment, hot melt ink is maintained in supply vessel 1 in a heated state. Preferably, the ink is maintained under static air pressure via an air pressure supply means not shown. When valve 40 is opened, ink flows from the supply tank to the nozzle 4, where the ink exits as a plurality of droplets. When the printing system of the present invention is operating, ink flows from supply chamber 1 through heated supply line 2, and into printhead 3 for ejection through nozzle 4 to either the substrate 5 or the catcher means 6. During printing operations some of the hot-melt ink droplets are intercepted by catcher means 6. The ink, after entering the catcher, is drawn to transfer vessel 39. Preferably, the ink is drawn through return line 7, which may be heated in the same fashion as is the supply line 2, into the transfer vessel 39 via a vacuum in the transfer tank which may be supplied by a continuous external vacuum source, not shown.

Ink in the transfer tank preferably remains in the transfer vessel until needed to replenish the supply vessel. As the supply vessel is preferably maintained under positive pressure, when ink is needed to be transferred from the transfer vessel to the supply vessel, a pump 33 is activated to pump ink from the transfer vessel through conduit 32 to the supply vessel, without interrupting the flow of hot melt ink from the supply vessel to the nozzle 4. This assures that the printing process can be continued without interruption due to lack of ink supply.

When the ink level in both the supply vessel and the transfer vessel reaches a predetermined low level, ink from the refill vessel 38 is allowed to flow to transfer vessel 39, through conduit 30, by opening valve 31. Preferably, vacuum in transfer vessel 39 is used to drive the flow to the transfer vessel. The refill vessel is preferably vented to the atmosphere at all times. Then the level of ink in the refill vessel falls below a predetermined level, the operator is signaled, who then adds solid hot melt ink to the refill tank. Thus, external hot melt ink may be added to the system without interfering with the printing process.

Of course, in accordance with either the embodiment of FIG. 1 or FIG. 1A, in line filters may be employed to remove particulate matter that may be in the fluid lines and may interfere with flow of ink throughout the system. Further, the actual means by which the solid hot melt ink is introduced into the system is not critical and can vary significantly, as can the means for detection of low and high levels of ink in the various vessels and the associated electronics and the like. Such means are shown, inter alia, in U.S. Pat. Nos. 4,631,557; 4,658,274; 4,667,206; 4,682,185; 4,682,187; 4,739,339; 4,814,786; 4,864,330; 4,940,995; 4,823,146; and 4,873,539.

Figure 2:
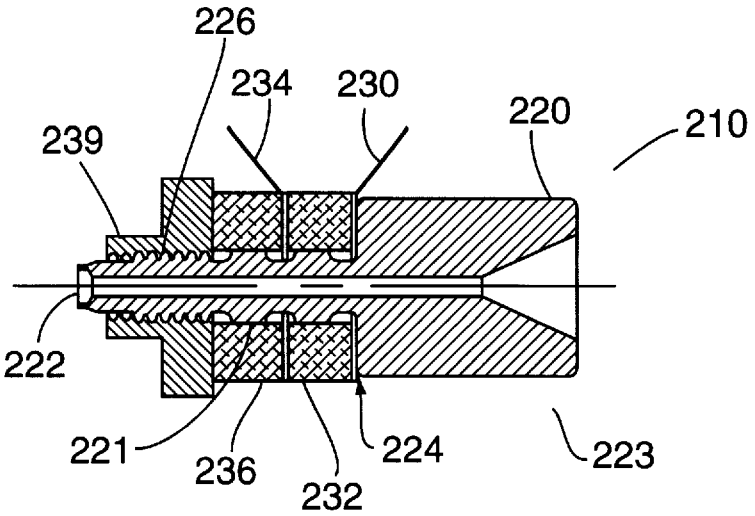
FIG. 2 is a print nozzle assembly of the prior art.

Printing with hot melt ink compositions presents a myriad of technical problems, as indicated, due to the fact that much of the system must be operated under relatively high temperatures. In actual practice, using the general system described above in FIG. 1, it was found that printing at operating temperatures became sporadic and unreliable, ultimately resulting in an apparent short circuit with the piezoelectric crystals, when using a print nozzle constructed in the normal fashion, as shown in FIG. 2. The reason for the instability and unreliability was not known. Initially, it was believed that the crystals themselves were failing under operating conditions.

As shown in FIG. 2, there is provided a nozzle assembly 210, having a housing 220, which is substantially cylindrical in shape with an axial passageway 222 for fluid flow. The upstream end of the housing has a region 221 with an external diameter that is less than downstream region 223, creating a shoulder 224. The upstream region 221 has external threads 226. A ground electrode 230 is placed adjacent the shoulder 224, in electrical communication with the housing 220. Preferably, the electrode has a circular terminal portion with an axial opening that allows the electrode to be slid over the upstream region 221 of the housing.

Adjacent the electrode 230 is located a first piezoelectric crystal 232, which also has an axial opening that allows it to be slid over the upstream region 221. A positive electrode 234 is then placed adjacent crystal 232, the positive electrode preferably having a similar terminal portion as the ground electrode, but the axial opening being large enough to assure that the electrode does not come in contact with the housing 220. Preferably, an insulating material is applied to region 221 in the vicinity of the electrode 234, to prevent any inadvertent shorting between that positive electrode and the nozzle body, which is grounded. Such shorting could be caused by slippage of the electrode between the piezoelectric crystals. It was such slippage in the original design that ultimately caused a short circuit to occur, after loss of acoustic coupling, due to the differential in thermal expansion.

A second piezoelectric crystal 236, of the same general configuration as the first crystal is then placed adjacent electrode 234. Finally, a locking nut 239 is placed over the threads 226, and tightened to create a compressive force axially along the crystals and electrodes, against the shoulder 224. Such compressive force provides for good acoustic coupling between the piezoelectric crystals and the housing.

Figure 3:
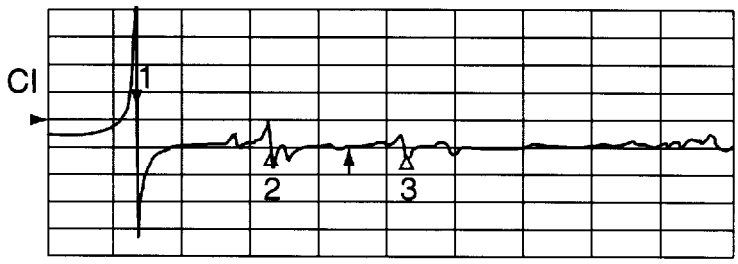
FIG. 3 is a diagram showing the acoustic coupling, under ambient temperature, for the print nozzle assembly of FIG. 1.
Figure 4:
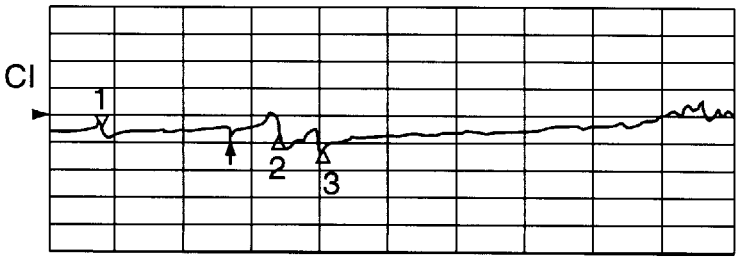
FIG. 4 is a diagram showing the acoustic coupling, under elevated temperature (240° F.), for the print nozzle assembly of FIG. 1.

Ultimately, it was then discovered that operation under such elevated temperature created a problem with the system that was traced to the print nozzle. In particular, it was discovered that the crystals of the piezoelectric transducer lost their acoustic coupling to the print housing at elevated temperature, due to differences in the thermal expansion between the crystals and the nozzle housing. The fact that the acoustic coupling was lost was confirmed by comparing the acoustic coupling under ambient conditions to that at an operating temperature of 240° C., as shown in FIGS. 3 and 4, for the nozzle assembly shown in FIG. 1.

Figure 5:
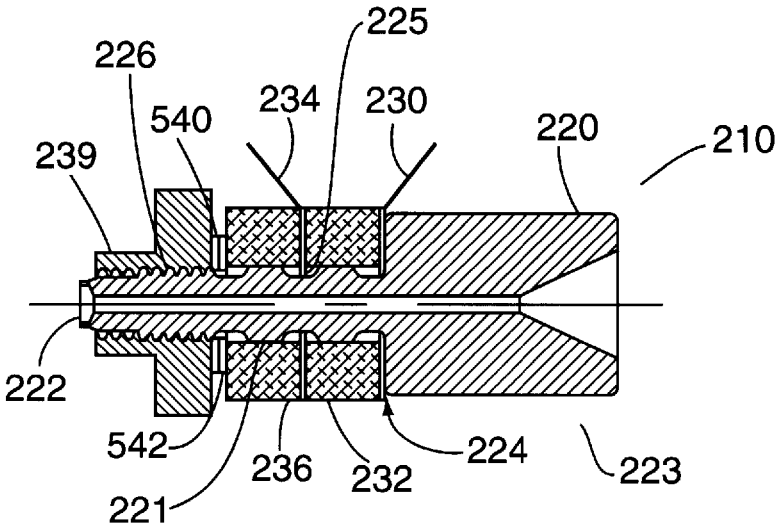
FIG. 5 is a print nozzle assembly of the present invention.

To address the problem of maintaining a proper acoustic coupling, the nozzle assembly of FIG. 2 was then modified, as shown in FIG. 5, in which all components have the same identification as in FIG. 2. In accordance with that embodiment, the nozzle assembly was modified by introducing a means for maintaining the acoustic coupling over a wide temperature range. This was accomplished by introducing a spring (or wave) washer 540, between the locking nut and the first piezoelectric crystal. A flat washer 542 was also used between the second piezoelectric crystal and the spring washer to assist in distributing the pressure to the first piezoelectric crystal. Tightening the nut then applies compressive force through the spring washer, which is distributed via the flat washer through the remaining components of the assembly to the shoulder 224.

The purpose of the spring washer was to compensate for the differences in the coefficients of linear thermal expansion, principally between the piezoelectric crystals and the housing, which is made of 316 stainless steel. Thus, the spring washer is capable of maintaining sufficient compressive force to maintain a good acoustic couple between the crystals and the housing over a broad temperature range, such as up to at least about 300° F. Accordingly, any compressive coupler that maintains such a compressive force may be used in place of the wave washer, such as a coil spring, or the like.

Figure 6:
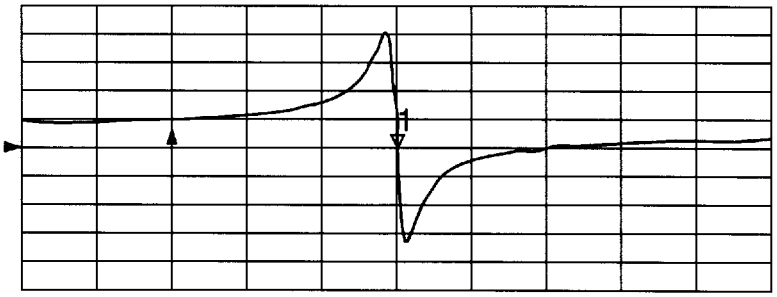
FIG. 6 is a diagram showing the acoustic coupling, under ambient temperature, for the print nozzle assembly of FIG. 5.
Figure 7:
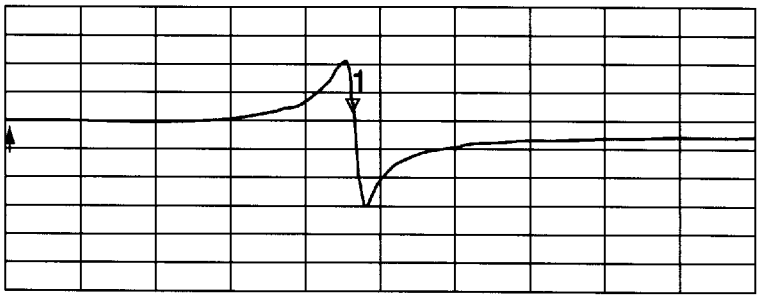
FIG. 7 is a diagram showing the acoustic coupling, under elevated temperature (240° F.), for the print nozzle assembly of FIG. 5.

The fact that the acoustic coupling was capable of being maintained at elevated operating temperature was confirmed by comparing the acoustic coupling under ambient conditions to that at an operating temperature of 240° C., as shown in FIGS. 6 and 7, respectively, for the modified nozzle assembly shown in FIG. 5. Actual use of the modified nozzle assembly of the present invention resulted in good continuous operation of the system, without instability of the print nozzle or shorting of the piezoelectric crystal circuit.

Although the invention has been described herein with reference to a specific embodiment, many modifications and variations therein will readily occur to those skilled in the art. Accordingly, all such variations and modifications are included within the intended scope of the invention as defined by the following claims.

All patents referred to above are incorporated by reference herein in their entirety.

What is claimed is:

1. An ink jet nozzle for use in printing hot-melt inks at elevated temperatures comprising an ink jet nozzle body having an inlet and an outlet; a transducer comprising two piezoelectric crystals that circumscribe at least a portion of said nozzle, and a first and a second electrode connected to said crystals to apply an electrical signal thereto; means for acoustically coupling said transducer to said body, and means for maintaining said transducer acoustically coupled to said body at elevated temperatures.

2. The nozzle of claim 1 wherein the means for maintaining said transducer acoustically coupled to said body at elevated temperatures comprises a spring washer that is capable of compensating for the difference in thermal expansion between said transducer and said ink jet nozzle body up to a temperature of about 300° F.

3. The ink jet nozzle of claim 1, wherein said means for maintaining said transducer acoustically coupled to said body at elevated temperatures is in direct contact with one of said piezoelectric crystals.

* * * * *